United States Patent [19]

Hunt

[11] Patent Number: 4,946,107

[45] Date of Patent: Aug. 7, 1990

[54] ELECTROMAGNETIC FUEL INJECTION VALVE

[75] Inventor: Donald E. Hunt, New Haven, Mo.

[73] Assignee: Pacer Industries, Inc., Washington, Mo.

[21] Appl. No.: 277,328

[22] Filed: Nov. 29, 1988

[51] Int. Cl.[5] ..... B05B 1/30

[52] U.S. Cl. ..... 239/585; 251/129.21

[58] Field of Search ..... 239/585; 251/129.15, 251/129.21

[56] References Cited

U.S. PATENT DOCUMENTS

| | | | |
|---|---|---|---|
| 4,360,161 | 11/1982 | Claxton et al. | 239/585 |
| 4,483,485 | 11/1984 | Kamiya et al. | 239/585 |
| 4,548,361 | 11/1985 | Paschke | 239/585 |
| 4,597,558 | 7/1986 | Hafner et al. | 251/129.15 |
| 4,711,397 | 12/1987 | Lahiff | 239/585 |

FOREIGN PATENT DOCUMENTS

| | | | |
|---|---|---|---|
| 2147690 | 5/1985 | United Kingdom | 239/585 |

OTHER PUBLICATIONS

Ford Motor Publication, "Injector Assembly–Fuel", pp. E-10 & 10.

American Association of Engineers, Paper 860486, pp. 125–129.

Automotive Industries, Feb. 1986, pp. 55–56.

*Primary Examiner*—Andres Kashnikow

*Assistant Examiner*—Karen B. Merritt

*Attorney, Agent, or Firm*—Neuman, Williams, Anderson & Olson

[57] ABSTRACT

An electromagnetically operable fuel injection valve for use with an internal combustion engine. The injection valve includes a non-magnetic housing having a fuel passage therethrough and a fixed magnetic core therein. A magnetic movable armature is floatably movable within a sleeve member within the housing. The movable armature has a nozzle portion of reduced diameter which carries at the exit end thereof a ball valve. A nozzle seat having a fuel discharge orifice is adapted for reception of the ball valve and means are provided for guiding said ball valve into sealing engagement with the discharge orifice.

5 Claims, 2 Drawing Sheets

ELECTROMAGNETIC FUEL INJECTION VALVE

This invention relates to an electromagnetically operated fuel injection device for internal combustion engines.

BACKGROUND

Electromagnetically operated fuel injection valves for internal combustion engines are now widely used. These valves serve to inject fuel into the air intake tube of mixture—compressing external ignition internal combustion engines.

Typically, fuel injectors of this type may have a movable core adapted to be electromagnetically driven by a solenoid, a valve member connected to the movable core for movement therewith into and out of sealing engagement with the valve seat. A spring member resiliently biases the movable core and the valve member toward the valve seat. When the solenoid is electrically energized, the movable core and the valve member are electromagnetically driven away from the valve seat against the spring force so that liquid fuel is forced out of the injector through the injector orifice into an associated internal combustion engine. When the solenoid is de-energized, the movable core is returned by the spring force so that the valve member is moved into sealing engagement with the valve seat to interrupt the injection of the liquid fuel.

OBJECTS OF THE INVENTION

Prior art electromagnetically operated fuel injection valves suffer from one or more shortcomings. Accordingly:

It is a principal object of this invention to provide a novel electromagnetic fuel injection valve which overcomes a number of shortcomings found in certain prior art injection valves.

It is another object of the invention to provide an electromagnetic fuel injection valve in which friction wear during operation is significantly reduced.

It is another object of the invention to provide an electromagnetic fuel injection valve which does not require extremely close manufacturing tolerances.

It is another object of the invention to provide an electromagnetic fuel injection valve which employs certain non-magnetic components which reduce undesired magnetic attraction as in prior art valves.

It is another object of the invention to provide an electromagnetic fuel injection valve which exhibits very quick response times in operation resulting in greater accuracy in fuel delivery.

It is another object of the invention to provide an electromagnetic fuel injection valve which is less prone to leakage than prior art valves.

It is another object of the invention to provide an electromagnetic fuel injection valve which provides good fuel delivery proportional to the open time of the valve.

It is another object of the invention to provide an electromagnetic fuel injection valve for which production setting and timing can be accomplished before assembly of the complete injector valve.

It is another object of the invention to provide an electromagnetic fuel injection valve which has a large fuel cavity near the exit point of the injector which reduces fuel restriction or squeeze action in the valve.

It is another object of the invention to provide an electromagnetic fuel injection valve in which the fuel passage is completely self-contained requiring no "o"-rings or separate seals which could contribute to fuel leakage.

SUMMARY OF THE INVENTION

The invention provides an electromagnetically operable fuel injection valve for use with an internal combustion engine. The injection valve includes a non-magnetic housing having a fuel passage therethrough and a fixed magnetic core therein. A magnetic movable armature is floatably movable within a non-magnetic sleeve member within the housing. The movable armature has a nozzle portion of reduced diameter which carries at the exit end thereof a ball valve. A nozzle seat having a fuel discharge orifice is adapted for reception of the ball valve and means are provided for guiding said ball valve into sealing engagement with said orifice.

DESCRIPTION OF PREFERRED EMBODIMENT

Figure 1:
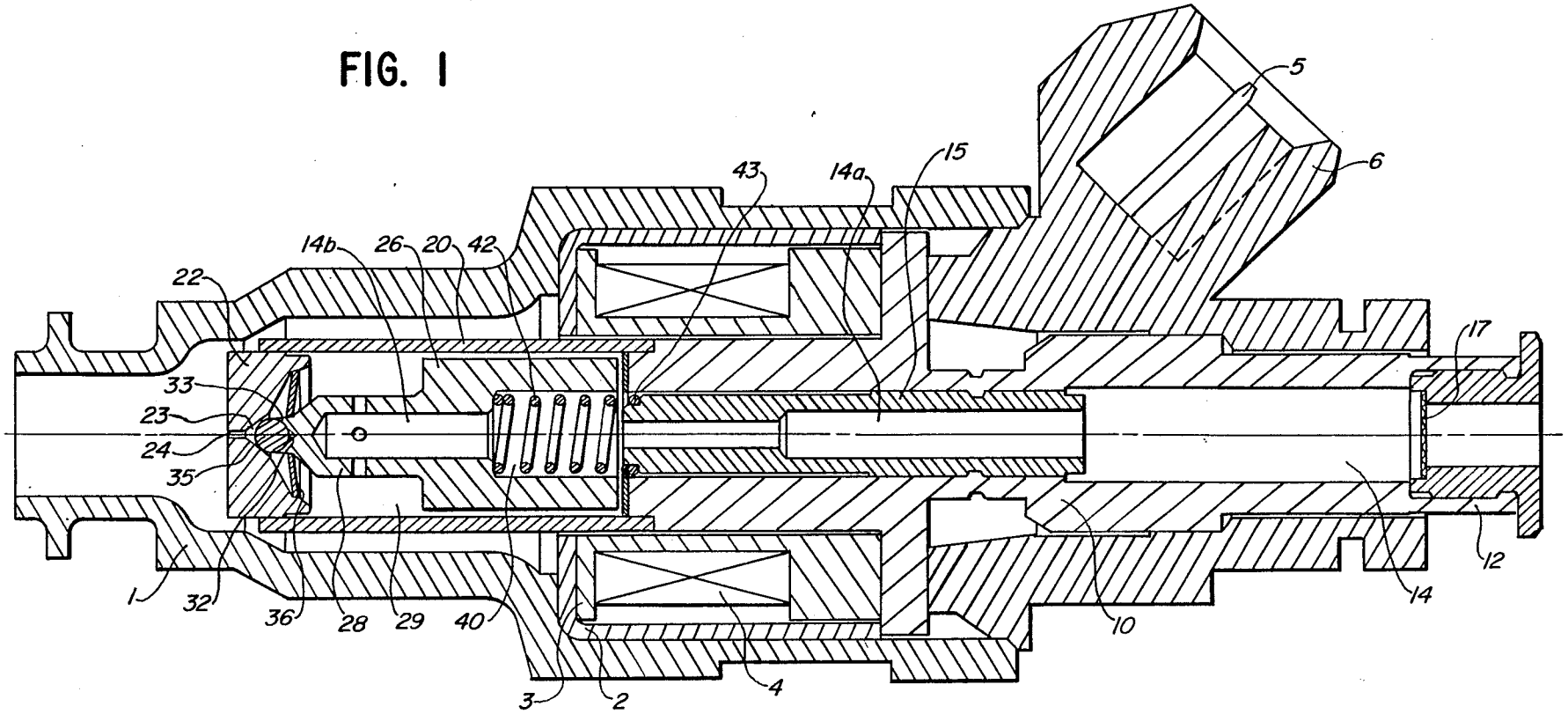
FIG. 1 is a sectional view of a preferred embodiment of a fuel injector according to the present invention.

Referring to the drawing, a generally cylindrical cup-shaped valve housing 1 is made of a non-magnetic material such as plastics, ceramics, stainless steel and the like. The housing 1 encloses coil housing 2 in which there is disposed bobbin 3 which carries electromagnetic coil 4. Electromagnetic coil 4 is electrically connected to terminals, one of which is shown at 5, which in turn are electrically connected to a control unit (not shown) by virtue of which electromagnetic coil 4 is electrically energized and de-energized. The operation of electromagnetic fuel injection valves is well known and the injector valve of this invention is electrically energized and de-energized in accordance with procedures well known in the art. The terminals 5 are imbedded in electrical connector 6 which can be formed of non-conductive materials, such as plastics or ceramics.

A fixed ferromagnetic core 10 extends axially within housing 1 with its outer end extending outwardly of housing 1 forming a connector tube 12. A centrally disposed fuel passage 14 is first defined by core 10 and then by annular adjusting insert 15.

Sealably attached to the lower end of fixed core 10 is sleeve member 20 which is formed of a non-magnetic material such as plastics, ceramics, stainless steel and the like. Sealably attached to the distal end of sleeve 20 is nozzle seat 22 which has a center cut-out portion 23 which leads to fuel discharge orifice 24. No separate seals are thus required between the fuel passages. Filter 17 is disposed within the intake of fuel passage 14.

Floatably movable in axial direction within non-magnetic sleeve 20 is a cylindrical magnetic armature valve 26. The diameter of armature valve 26 is smaller than the diameter of sleeve 20 so that armature valve 26 can floatably move axially therein in frictionless manner. A space on the order of 0.010 to 0.030 inch between armature valve 26 and sleeve 20 is preferred. Movable armature valve 26 is formed with a nozzle portion 28 of reduced diameter which provides a fuel cavity 29 between the nozzle and sleeve 20. It is preferred that the volume of fuel cavity 29 be at least about 10 times the volume of fuel delivered per pulse. Armature valve 26 has a hollow central portion which forms fuel passage 14b which is a continuation of fuel passage 14a.

A V-shaped notch 32 is formed at the exit end of nozzle 28 with the wings of the notch forming guide tips 33. Ball valve 35 is secured in notch 32 and is of a size to fit within the cut-out portion 23 of nozzle seat 22. For example, ball valve 35 can have a circumference of say 1/16 inch, with cut-out portion 23 being of appropriate size to receive ball valve 35 in sealing engagement with orifice 24. Guide means such as flat spring member 36 attached to nozzle seat 22 are provided to guide ball valve 35 into sealing engagement with fuel discharge orifice 24.

Spring pocket 40 centrally located within the upper portion of movable armature valve 26 accommodates compression coil spring 42, the ends of which are secured within annular recess 43 in adjusting insert 15.

Compression spring 42 resiliently biases the movable armature valve 26 away from the fixed core 10 so that ball valve 35 guided by flat spring 36 closes fuel discharge orifice 24 permitting no fuel flow to the internal combustion engine. Upon electrical energization, armature valve 26 and ball valve 35 move away from the valve seat thus permitting fuel to flow through orifice 24 into the internal combustion engine. Upon de-energization, the movable armature valve 26 is returned by the force of spring 42 to move ball valve 35 into sealing engagement with discharge orifice 24, thus interrupting fuel flow to the combustion engine. The open time of the valve (pulse width) during which fuel is injected into the combustion engine can be set as desired by known means.

From the above description it is apparent that the construction of the fuel injection apparatus of this invention provides various significant advantages.

In the fuel injector of this invention movable armature valve 26 moves axially within the non-magnetic sleeve 20 without rubbing contact and ball valve 35 is guided into the nozzle seat 22. This arrangement substantially reduces friction wear and does not require close manufacturing tolerances in contrast to fuel injectors in which a fuel injection needle slides within an elongated seat bore. Such arrangements require extremely close manufacturing tolerances for the injection needle and seat bore and considerable friction wear occurs within the valves.

The described valve employs non-magnetic materials for the housing 1 and sleeve 20, thereby limiting the magnetic attraction to the movable armature valve 26 and fixed magnetic core 10. This prevents uneven lateral movement of the movable armature valve 26 which would cause friction wear and slower valve response time.

Known electromagnetic fuel injectors typically have an open time (pulse width) in a range of about 2 milliseconds to 10 milliseconds. Prior art fuel injectors have a poor linear flow delivery at the low pulse width operation, such as 3 milliseconds, because of friction and hydraulic action which does not allow the valve to open fully. In contrast, the fuel injector valve of this invention provides quick operational response time in both closing and opening of the valve due to the fact that the movable armature valve 26 does not frictionally engage sleeve 20. This results in greater accuracy in fuel delivery close to the ideal linearity rate of fuel injection.

In the fuel injector of the invention fuel passage 14 (including 14a and 14b) is completely contained and sealed by integral valve elements and no separate seals such as "o" rings or gaskets are required.

The construction of the fuel injector of the invention, and particularly the nozzle 28 which is of reduced size as compared with the upper portion of armature valve 26, provides a relatively large fuel cavity or chamber 29 near the exit point of the injector which relieves fuel restriction or squeeze action. The elimination of squeeze action is desirable since such impedes the movement of the valve member slowing response of the fuel injector.

Figure 2:
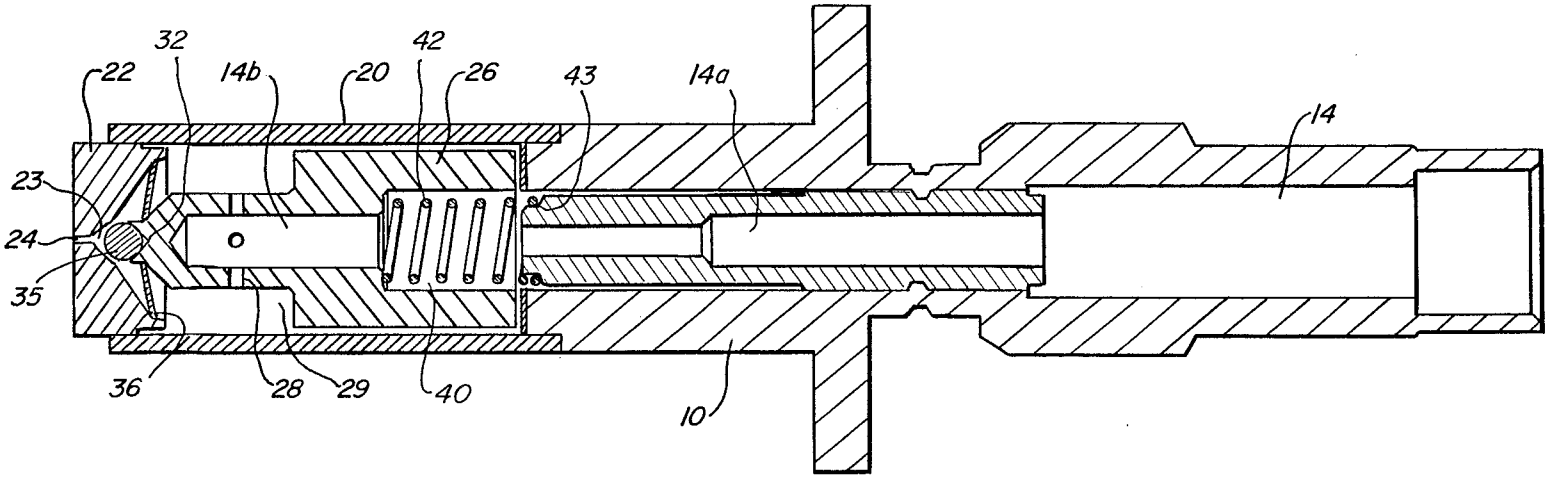
FIG. 2 is a view similar to FIG. 1 with some parts of the fuel injector not shown.

It is significant also that the fuel passage assembly (see FIG. 2) is separate from the housing 1, coil housing 2, bobbin 3, coil 4 and connector 6. Thus, with the present fuel injector valve, setting of the valve and testing thereof can be accomplished before the injector is completely assembled.

Those modifications and equivalents which fall within the spirit of the invention are to be considered a part thereof.

What is claimed is:

1. An electromagnetically operable fuel injection valve for use with an internal combustion engine, said injection valve including:

a housing having a fuel passage therethrough, a fixed magnetic core disposed within said housing, a non-magnetic sleeve within said housing, a magnetic movable armature floatably movable within said sleeve without frictional engagement, said movable armature having a nozzle portion of reduced diameter which carries at the exit end thereof a ball valve, a nozzle seat for reception of said ball valve having a fuel discharge orifice therein, and means for guiding said ball valve into sealing engagement with said orifice.

2. A valve in accordance with claim 1 wherein the said housing is fabricated of a non-magnetic material.

3. A valve in accordance with claim 1 wherein flat spring means guide the ball valve into sealing engagement with said orifice.

4. A valve in accordance with claim 1 wherein the fuel passage is continuous and completely defined by rigid valve elements sealably secured to one another.

5. A valve in accordance with claim 1 wherein the components defining the fuel passage, the fixed magnetic core and the said movable armature are separate from the housing so as to permit testing of the valve prior to assembly of the complete valve.

* * * * *